US005439043A

United States Patent [19]

Carter

[11] Patent Number: 5,439,043

[45] Date of Patent: Aug. 8, 1995

[54] DISPLAY SYSTEM

[76] Inventor: Wallace T. Carter, 118 Holiday Hills Dr., Wilmington, N.C. 28409

[21] Appl. No.: 148,617

[22] Filed: Nov. 8, 1993

[51] Int. Cl.[6] ..... A47G 5/00

[52] U.S. Cl. ..... 160/135; 52/DIG. 4; 52/736.1

[58] Field of Search ..... 160/135, 351, 352; 52/720, 724, 727, DIG. 4; 40/605, 606, 610

[56] References Cited

U.S. PATENT DOCUMENTS

| | | | |
|---|---|---|---|
| 2,044,422 | 2/1936 | Davidson . | |
| 2,193,469 | 3/1940 | Ashton | 160/352 |
| 2,266,854 | 12/1941 | Davis | 160/352 X |
| 2,324,398 | 7/1943 | Kahr | 160/135 X |
| 2,577,667 | 12/1951 | Waite | 160/135 X |
| 3,571,999 | 3/1971 | Downing | 40/605 X |
| 3,798,867 | 3/1974 | Starling | 52/724 |
| 3,928,930 | 12/1975 | Attwood . | |
| 4,606,167 | 8/1986 | Thorne | 52/727 |
| 4,865,111 | 9/1989 | Perutz . | |
| 4,979,554 | 12/1990 | Nelson | 160/135 |
| 5,067,547 | 11/1991 | Movrich | 160/327 |
| 5,150,554 | 9/1992 | Quinlan et al. | 160/351 X |

*Primary Examiner*—David M. Purol
*Attorney, Agent, or Firm*—Diller, Ramik & Wight

[57] ABSTRACT

A display system includes a display panel spanning first and second pairs of stacked hollow columns with each column being formed from a sheet of resilient material folded to bring opposite edges into contiguous relationship to each other. Clips and/or magnets are used to secure the contiguous edges to each other. Each edge of each column also includes a hollow tube which imparts rigidity thereto and diametrically opposite such tubes is a third tube. Pins are received in the aligned tubes of stacked columns to maintain the same in stacked relationship.

29 Claims, 3 Drawing Sheets

FIG. 2
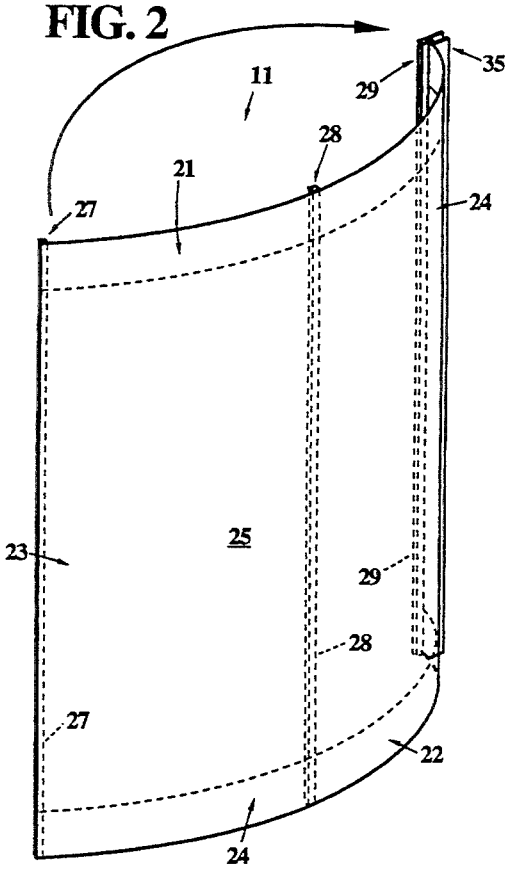
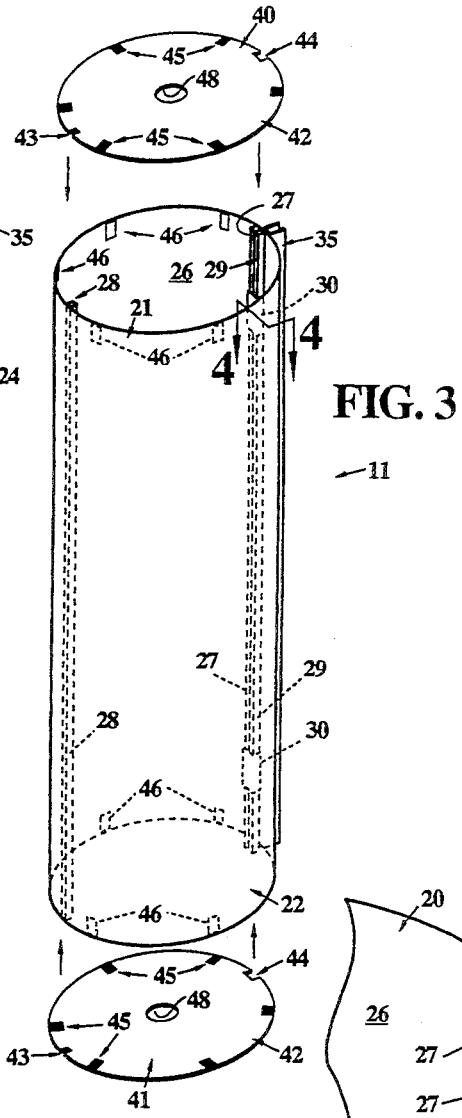
FIG. 3
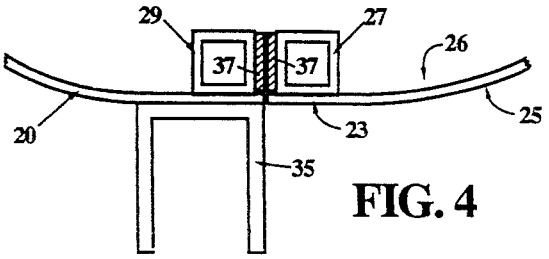
FIG. 4
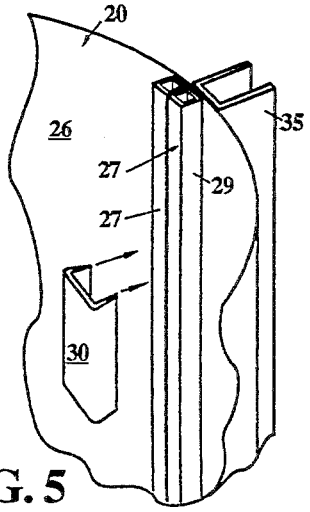
FIG. 5

DISPLAY SYSTEM

BACKGROUND OF THE INVENTION

The invention is directed to display systems which are portable, free standing and can be readily erected, reconfigured, knocked-down, packed and transported for display at sales presentations, press conferences, seminars, etc. The display system of the present invention is designed to provide a large architectural atmosphere without sacrificing portability, and doing so through the utilization of stately columns and contemporary curves which provide a spacious three dimensional presence with the flexibility of being easily reconfigured into larger or smaller free standing displays or tabletop displays. The display system includes at least two columns spanned by a display panel, although for larger display panels the columns can be stacked resulting in a corresponding increase in the display panel area therebetween. The columns of the present display system avoid the general complexities of many display systems, structurally and aesthetically improve performance of folding panel display systems and in doing so keep erection of the display system simple, requiring no tools, and with a minimum number of parts all of which are extremely light-weight and packed flat or rolled to substantially smaller compact proportions for storage and shipment.

SUMMARY OF THE INVENTION

The display system includes at least one display panel and a column at each edge secured to the display panel with each column being formed from a sheet of resilient material having opposite edges disposed contiguous each other thereby imparting a generally hollow configuration to each column. A generally hollow tubular elongated member is secured to each opposite edge of the sheet and to a portion of the sheet approximately midway between the sheet opposite edges. Therefore when the sheet is disposed with its edges contiguous to each other, two of the tubular elongated members are adjacent each other and the third is generally diametrically opposite thereto. The adjacent or contiguous tubular elongated members are secured to each other by, for example, magnetic strips and/or plastic spring clips and another generally U-shaped elongated member is secured to one of the sheet edges for securing each column to an associated edge of an associated display panel. In this fashion two relatively flat sheets of resilient material can be each formed into a column with each column being then secured to opposite vertical edges of a central display panel thereby forming an aesthetic display system.

In order to increase the overall size of the display system, an additional column (or more) can be stacked upon the first two described columns and another panel spanned therebetween. When the columns are stacked, preferably pins are introduced into opposing adjacent ends of the tubular elongated members of the upper and lower columns to maintain the stacked columns axially aligned and stable.

While the tubular elongated members impart rigidity to the columns, additional rigidity can also be imparted thereto by inserting one or more circular disks into each column. Preferably a plastic circular disk is inserted into each column at each of opposite axial ends thereof. Each disk is preferably removably secured within each column by hooked tape (VELCRO®). Furthermore, a periphery of each disk has slots or notches which embrace the tubular elongated members which effectively aligns the securement hook tapes carried by each disk and the interior of the column and additionally assures integrity, compression strength and the desired configuration of each column by preventing displacement of each disk relative to its desired position within its associated column.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 2 is a perspective view of one of the four identical columns illustrated in FIG. 1, and illustrates the manner in which the same is constructed from a sheet of polygonal resilient material having three tubular elongated members secured to one side of the sheet and a generally U-shaped elongated member secured to an opposite side of the sheet with the sheet being illustrated in a partially curved configuration.

FIG. 3 is an exploded view of a column constructed from the sheet of FIG. 2, and illustrates opposite edges of the sheet brought into contiguous relationship with each other, secured together, and two disks prior to being inserted within and secured to upper and lower end portions of the column.

FIG. 4 is an enlarged fragmentary cross sectional view taken generally along line 4—4 of FIG. 3, and illustrates magnetic strips carried by two of the tubular elongated members securing the edges of the sheet together and a plastic U-shaped clip spanning and clamped to the pair of tubular elongated members.

FIG. 5 is a fragmentary perspective view of the area of the column illustrated in FIG. 4, and illustrates the manner in which the plastic clip is aligned prior to being clipped to the magnetically secured tubular elongated members.

DESCRIPTION OF THE PREFERRED EMBODIMENTS

Figure 1:
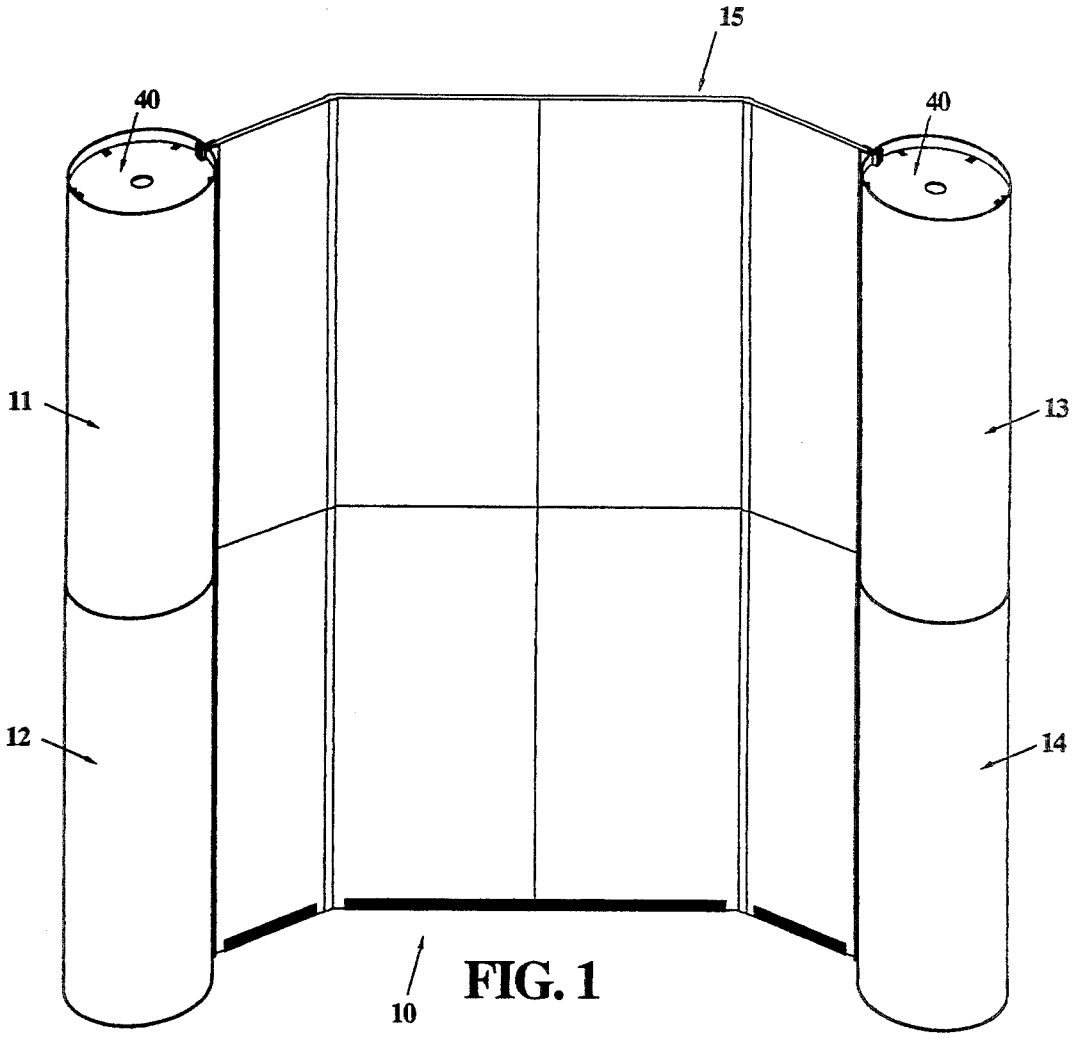
FIG. 1 is a perspective view of a novel display system of the present invention and illustrates two pairs of stacked columns and a folding panel display therebetween.

A novel display system constructed in accordance with this invention is fully illustrated in FIG. 1 of the drawings and is generally designated by the reference numeral 10.

The display system 10 includes four identical columns 11–14 with each column being of a generally cylindrical configuration. As is apparent from FIG. 1, the columns 11 and 12 are stacked relative to each other in axially aligned relationship, as are the columns 13 and 14.

A foldable or folding panel display or display panel 15 is in spanning relationship to the stacked columns 11, 12 and 13, 14. The folding panel display 15 is of a conventional construction and includes eight rectangular panel portions (unnumbered) and associated fold lines (also unnumbered) for permitting the folding panel display 15 to be folded relatively flat, packed for shipping purposes, unpacked and unfolded to the configuration shown in FIG. 1. The columns 11–14 and the folding panel display 15 are provided with appropriate designs, photomurals, graphics and the like.

The column 11 is constructed from resilient paper or plastic material and in a manner which is best shown in FIGS. 2–5 of the drawings, and the manufacture, assembly and disassembly of the columns 12–14 is equivalent thereto. Accordingly, the following description of the column 11 applies equally to each of the columns 12–14.

The column 11 is preferably constructed from a sheet 20 of polymeric/copolymeric synthetic material having a top edge portion 21 which is generally parallel to a bottom edge portion 22 and side or lateral edge portions 23, 24 which are similarly parallel to each other imparting a generally upright rectangular configuration to the overall sheet 20. The sheet 20 is normally flat and is illustrated partially curved in FIG. 2 only for purposes of describing the manner in which the flat sheet 20 is eventually formed into the hollow cylindrical configuration of the column 11 (FIG. 3). An exterior surface of the sheet 20 is designated by the reference numeral 25 while an interior surface of the sheet 20 is designated by the reference numeral 26. Though not illustrated, the exterior surface 25 is also provided with appropriate graphics, designs, etc.

Three relatively identical tubular elongated members or tubes 27, 28 and 29 are secured to the inner surface 26 of the sheet 20 by adhesive or in any other conventional manner. The tubular elongated member 27 is secured along the edge 23 of the sheet 20 and the elongated tubular member 29 is secured to the edge 24. The tubular elongated member 28 is secured at a point approximately midway between the tubular elongated members 27, 29 and parallel thereto. Due to the latter construction and dimensioning, when the elongated tubular members 27, 29 are brought into contiguous and/or touching relationship with each other by curving the sheet 20 from its flat/planar configuration (not shown) through the partial curvature shown in FIG. 2 toward the final cylindrical configuration shown in FIG. 3, the tubular elongated member 28 is generally diametrically opposed to the tubular elongated members 27, 29 (see FIG. 3).

Means are provided for securing the sheet 20 in the cylindrical configuration shown in FIG. 3, namely, respective magnetic strips 37, 37 (FIG. 4) secured to opposing surfaces (unnumbered) of the respective tubular elongated members 27, 29. The magnetic strips 37, 37 are obviously magnetically attractive to each other and thereby secure the edges 23, 24 of the sheet 20 contiguous each other, as is clearly evident in FIG. 5 of the drawings. However, one or more generally shallow U-shaped plastic spring clips 30 can be clipped in spanning relationship to the tubular elongated members 27, 29 adjacent the upper and lower edges 21, 22, respectively, of the column 11, as is best illustrated in FIGS. 3 and 4 of the drawings. Essentially the clips 30 have legs (unnumbered) which are slightly closer together than the distance between the opposite faces (unnumbered) of the tubular elongated members 27, 29, and thus when pushed thereon in the manner indicated by the unnumbered headed arrows associated therewith in FIG. 5, retain the tubular elongated members 27, 29 in clamped securement thereby augmenting the securement effected by the magnetic strips 37, 37.

Figure 6:
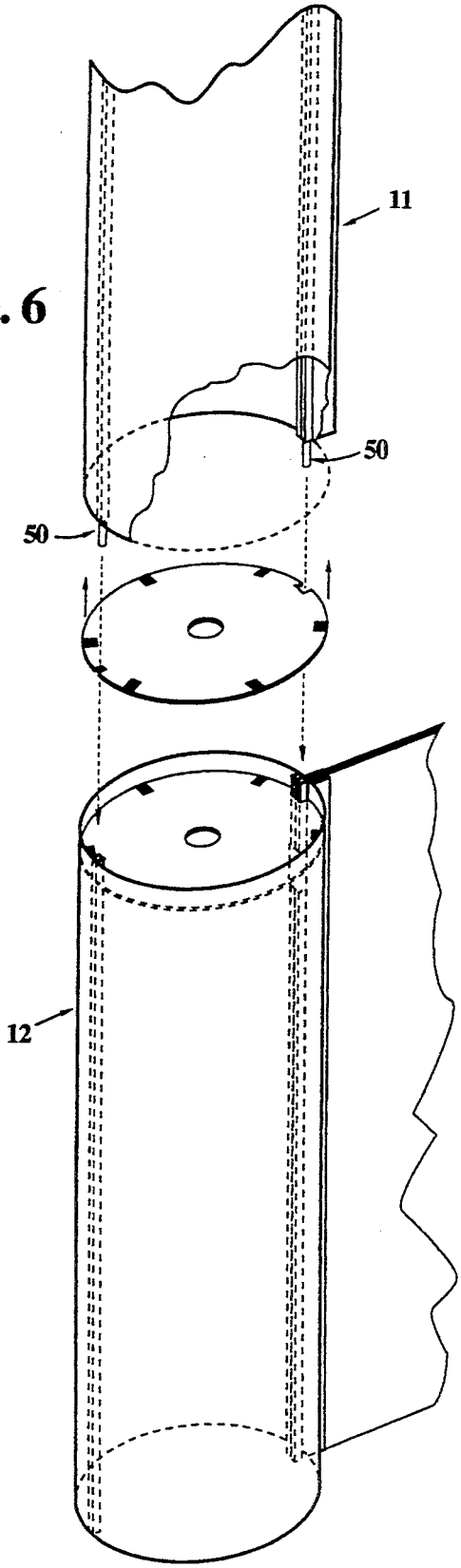
FIG. 6 is a fragmentary perspective view with portions broken away for clarity of the left hand stacked columns of FIG. 1, and illustrates pins associated with the diametrically opposite tubular elongated members for interlocking the stacked columns in axially aligned relationship.

A generally U-shaped securing bar 35, which is also of relatively elongated construction, is suitably secured to the surface 25 of the sheet 20 along the edge 24, as is best illustrated in FIG. 4 of the drawings. Each generally U-shaped securing member or bar 35 receives an associated edge (unnumbered) of the panel display 15, as is most apparent in FIGS. 1 and 6 of the drawings, and thereby maintains the folding panel display 15 in its upright erected position (FIG. 1).

While the column 11 is relatively rigid and stable due to the elongated tubular members 27–29, the column 11 is further rigidified by a pair of identical disks 40, 41 constructed of plastic, paper or similar material. The disks 40, 41 are each contoured to the circular configuration of the interior surface 26 of the column 11 and a peripheral edge 42 of each is provided with generally diametrically opposite radially outwardly opening slots 43, 44, the latter being larger than the former to slidably confineably embrace the respective tubular elongated members 28 and 27, 29, respectively. A plurality of hooked tape means 45, 46, such as VELCRO® tape, are provided along the peripheral edge 42 of each disk 40, 41 and along the interior surface 26 at the top and bottom edge portions 21, 22 of the column 11, respectively. The hooked tapes 45, 46 are spaced arcuately to align with each other and such alignment is assured by the engagement of the slots 43, 44 with the respective tubular elongated members 28 and 29, 30. Thus, to assembly the disks 40, 41 within the column 11, the slots 43, 44 are simply aligned with the respective tubular elongated members 28 and 29, 30, the disks are slid axially inwardly, and the hooked tapes 45, 46 are now in alignment and need but be pressed together to fix the disks 40, 41 in position adjacent to respective upper and lower edges 21, 22, respectively. A central circular opening 48 in each disk 40, 41 is of a size to permit the disks 40, 41 to be manually gripped for purposes of insertion and removal. However, when the disks 40, 41 are firmly secured by the hooked tapes 45, 46 adjacent the end portions or edges 21, 22 of the column 11, the latter is extremely rigid and distortion of the cylindrical configuration of the column 11 under axial or sidewise loading or forces is virtually precluded. Furthermore, for relatively vertically short displays or table-top displays, an imperforate decorative circular cover can be seated atop the disk 40 for aesthetic purposes.

As is most evident from FIG. 1 of the drawings, the columns 11, 12 are stacked upon each other such that the U-shaped bars 35 are aligned to receive the edge (unnumbered) of the panel display 15 and the same is true of the U-shaped channels 35 of the columns 13, 14. In this fashion the display system 10 is self supporting and sustaining. However, it is also within the scope of this invention to provide means for effecting axial alignment and stacked interlock between the columns 11, 12 and 13, 14, respectively, and this is performed by means 50 (FIG. 6) in the form of relatively long pins 50, one of which is inserted into the tubular elongated members 28 of the stacked columns 11, 12 and 13, 14, and the other of which is inserted into either one of the aligned tubular members 27 or 29 of the stacked columns 11, 12 and 13, 14. In this fashion the stacked columns 11, 12 are effectively locked at diametrically opposite points, as is most readily apparent from FIG. 6, and inadvertent disassembly of the stacked condition shown in FIG. 1 is precluded whereas disassembly is readily achieved by simply telescopically disuniting the respective pairs of columns 11, 12 and 13, 14.

Figure 7:
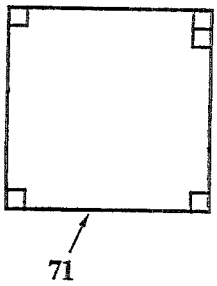
FIGS. 7–9 are schematic cross sectional views of three additional columns constructed in accordance with this invention, but in lieu of the circular cross section of the columns of FIGS. 1–6, the columns of FIGS. 7–9 are respectively of square, hexagonal and octagonal cross sectional configurations.
Figure 8:
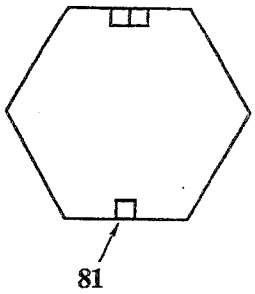
Figure 9:
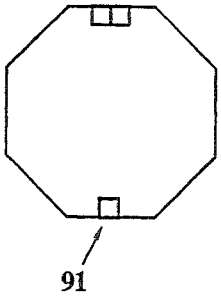

Reference is now made to FIGS. 7–9 of the drawings which illustrate three columns 71, 81 and 91, respectively. The construction of the columns 71, 81, 91 is identical to that described relative to the column 11 except that the axial cross sectional configurations thereof are respectively polygonal/square, hexagonal and octagonally.

Although a preferred embodiment of the invention has been specifically illustrated and described herein, it is to be understood that minor variations may be made in the apparatus without departing from the spirit and scope of the invention, as defined in the appended claims.

I claim:

1. A display system comprising a display panel and at least one column, said column being formed from a sheet of resilient material having opposite edges disposed contiguous each other thereby imparting a generally hollow interior to said column, first means for securing said opposite edges to each other, second means for securing said column to said display panel, means in said hollow interior for rigidifying said column, and third means for securing said rigidifying means to said column.

2. The display system as defined in claim 1 wherein said first securing means include magnetic attractive securing means.

3. The display system as defined in claim 1 wherein said first securing means includes clip securing means.

4. The display system as defined in claim 1 wherein said first securing means includes magnetic attractive securing means and clip securing means.

5. The display system as defined in claim 1 wherein said second securing means includes clip means carried by said column for engaging an edge of said display panel.

6. The display system as defined in claim 1 wherein said second securing means includes clip means carried by one of said column edges for engaging an edge of said display panel.

7. The display system as defined in claim 1 wherein said third securing means includes releasable hook tape means carried by said rigidifying means and said column.

8. The display system as defined in claim 1 including first and second elongated members secured to and reinforcing respective first and second of said sheet opposite edges, and said first securing means is carried by at least one of said first and second elongated members.

9. The display system as defined in claim 1 including first and second elongated members secured to and reinforcing respective first and second of said sheet opposite edges, and said first securing means are carried by both of said first and second elongated members.

10. The display system as defined in claim 1 including first and second elongated members secured to and reinforcing respective first and second of said sheet opposite edges.

11. The display system as defined in claim 1 including first and second elongated members secured to and reinforcing respective first and second of said sheet opposite edges, and a third elongated member secured to and reinforcing a longitudinal portion of said column generally diametrically opposite said first and second elongated members.

12. The display system as defined in claim 1 wherein said rigidifying means is a disk-like member.

13. The display system as defined in claim 1 wherein said rigidifying means is a disk-like member, and said disk-like member includes a peripheral edge having slot means for embracingly receiving said first securing means.

14. The display system as defined in claim 1 wherein said rigidifying means are a pair of disk-like members located one each at generally axially oppositely ends of said column.

15. A stacked column particularly adapted for utilization as part of a display system comprising first and second generally hollow columns each having axially opposite top and bottom end portions, said first hollow columns being stacked upon said second hollow column, each said columns being formed from a sheet of resilient material having opposite edges disposed contiguous each other thereby imparting a generally hollow interior to each said columns, means for securing the opposite edges of said first column to each other, means for securing the opposite edges of said second column to each other, and a pair of means spanning between said first and second column respective bottom and top end portions for maintaining said columns axially aligned in their stacked relationship.

16. The stacked column as defined in claim 15 wherein said spanning means includes a pair of pins.

17. The stacked column as defined in claim 15 wherein said spanning means are disposed in generally diametrically opposite relationship to each other.

18. The stacked column as defined in claim 15 wherein said spanning means are disposed in generally diametrically opposite relationship to each other interiorly of said hollow columns.

19. The stacked column as defined in claim 15 wherein said spanning means includes a pair of pins, and said pair of pins are received in a pair of sockets Of each of said columns.

20. The stacked column as defined in claim 17 wherein said spanning means includes a pair of pins.

21. The stacked column as defined in claim 18 wherein said spanning means includes a pair of pins.

22. The stacked column as defined in claim 19 wherein said spanning means are disposed in generally diametrically opposite relationship to each other.

23. The stacked column as defined in claim 19 wherein said spanning means are disposed in generally diametrically opposite relationship to each other interiorly of said hollow columns.

24. A display system sheet particularly adapted to be formed into a hollow column of a display system comprising a generally resilient polygonal member defined in part by opposite generally parallel edge portions adapted to be brought into contiguous relationship to each other, at least one elongated member secured along one of said edge portions, at least a further elongated member secured to said polygonal member in generally parallel relationship to said one member and generally midway between said opposite parallel edge portions, and said one and further elongated members are tubular.

25. The display system sheet as defined in claim 24 wherein said one and further elongated members are tubular and are generally of a length corresponding to the length of said parallel edge portions.

26. A display system sheet particularly adapted to be formed into a hollow column of a display system comprising a generally resilient polygonal member defined in part by opposite generally parallel edge portions adapted to be brought into contiguous relationship to each other, at least one elongated member secured along one of said edge portions, at least a further elongated member secured to said polygonal member in generally parallel relationship to said one member and generally midway between said opposite parallel edge portions, an additional elongated member secured along the other of said edge portions, and said elongated members are tubular.

27. A display system sheet particularly adapted to be formed into a hollow column of a display system comprising a generally resilient polygonal defined in part by opposite generally parallel edge portions adapted to be brought into contiguous relationship to each other, at least one elongated member secured along one of said edge portions, at least a further elongated member secured to said polygonal member in generally parallel relationship to said one member and generally midway between said opposite parallel edge portions, an additional elongated member secured along the other of said edge portions, and means for securing said one and additional elongated members to each other.

28. A display system sheet particularly adapted to be formed into a hollow column of a display system comprising a generally resilient polygonal member defined in part by opposite generally parallel edge portions adapted to be brought into contiguous relationship to each other, at least one elongated member secured along one of said edge portions, at least a further elongated member secured to said polygonal member in generally parallel relationship to said one member and generally midway between said opposite parallel edge portions, an additional elongated member secured along the other of said edge portions, and magnetic means for securing said one and additional elongated members to each other.

29. A stacked column particularly adapted for utilization as part of a display system comprising first and second generally hollow columns each having axially opposite top and bottom end portions, said first hollow columns being stacked upon said second hollow column, each said columns being formed from a sheet of resilient material having opposite edges disposed contiguous each other thereby imparting a generally hollow interior to each said columns, means for securing the opposite edges of said first column to each other, means for securing the opposite edges of said second column to each other, and means spanning between said first and second column respective bottom and top end portions for maintaining said columns axially aligned in their stacked relationship.

* * * * *